US005519407A

United States Patent [19]

Mileski

[11] Patent Number: 5,519,407

[45] Date of Patent: May 21, 1996

[54] CIRCULARLY POLARIZED DUAL FREQUENCY LIGHTWEIGHT DEPLOYABLE ANTENNA SYSTEM

[75] Inventor: Paul M. Mileski, Mystic, Conn.

[73] Assignee: The United States of America as represented by the Secretary of the Navy, Washington, D.C.

[21] Appl. No.: 320,617

[22] Filed: Oct. 7, 1994

[51] Int. Cl.[6] ..... H01Q 21/26; H01Q 1/34

[52] U.S. Cl. ..... 343/722; 343/709; 343/797; 343/821

[58] Field of Search ..... 343/709, 722, 343/797, 802, 805, 820, 821; H01Q 21/26, 1/34, 9/16

[56] References Cited

U.S. PATENT DOCUMENTS

| | | | |
|---|---|---|---|
| 3,176,298 | 3/1965 | Nettles | 343/722 |
| 3,769,622 | 10/1973 | Munson | 343/797 |
| 3,789,416 | 1/1974 | Kuecken et al. | 343/797 |
| 5,091,732 | 2/1992 | Mileski et al. | 343/797 |

*Primary Examiner*—Michael C. Wimer

*Attorney, Agent, or Firm*—Michael J. McGowan; Prithvi C. Lall; Michael F. Oglo

[57] ABSTRACT

A deployable antenna assembly includes a canister providing an elongated chamber and an elongated hollow mast with a mounting member on its upper end. A coaxial cable extends into the hollow mast to provide radio signals to the antenna assembly of four antenna members of resiliently deflectable members spaced at 90 degree intervals about the periphery of a mounting plate. In the non-deployed position elongated arms extend downward along the inner wall of a canister. A resonant circuit having an inductive coil and a capacitor are located at an intermediate position on the arms. A smooth material is placed between the resonant circuit and the wall of the canister to prevent scraping and damage to the resonant circuit upon deployment. Each opposed pair of antenna element comprises a dipole. A pair of baluns are formed by the arrangement of coaxial cable. A hybrid circuit forming a phase shifter is securely affixed to a mounting plate.

5 Claims, 3 Drawing Sheets

CIRCULARLY POLARIZED DUAL FREQUENCY LIGHTWEIGHT DEPLOYABLE ANTENNA SYSTEM

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates to a compactly stowed deployable antenna system. More particularly, the antenna system is operable on two frequencies simultaneously.

(2) Description of the Prior Art

As recited in U.S. Pat. No. 5,091,732, Lightweight Deployable Antenna System in which I was a co-inventor with Jeffrey Kornblith, underwater installations and submersible vehicles occasionally require antennas above the surface of the water for transmission of radio signals to other installations and vessels. Space applications similarly may require compact deployable antenna systems. Field applications of the military rescue units, explorers and the like also require compact antenna assemblies for ready transport and rapid deployment.

The device of the aforementioned patent met these requirements. The present inventive device is a patentable modification having circular polarization and a wider bandwidth than the Deployable Antenna System in U.S. Pat. No. 5,091,732. The prior antenna system allows a lightweight deployable antenna to operate within only one relatively narrow band of frequencies. This narrow range of frequencies is inadequate for compatibility with communication systems which require simultaneous operation at two relatively widely spaced frequency bands such as 250 MHz and 350 MHz. The circular polarization gives the system satellite compatability.

Most antennas gain wide bandwidth or dual band operation by the use of large, heavy, bulky elements that are not compatible with the features of the present invention. As an example, U.S. Pat. No. 3,176,298, Attachment for Antennas to Reduce Operating Frequencies, by W. E. Nettles shows coils similar to those in the present invention. However, the arrangement of these coils as shown by Nettles would not be suitable in the present invention as excessive snagging and scraping would take place upon attempted deployment of the antenna system.

SUMMARY OF THE INVENTION

Accordingly, it is a general purpose and object of the present invention to provide an improved deployable antenna. This antenna system is suitable for operation on more than one frequency band. It is suitable for operation in conjunction with satellites. In addition it retains all the desirable features of the device of U.S. Pat. No. 5,091,732, such as remote deployability, mechanical integrity, portability, and low wind loading.

These objects are accomplished with the present invention by providing a system having the same mechanical features as U.S. Pat. No. 5,091,732, but including the following additional unique features. The first such feature is the replacement of the baluns with a type having a much wider bandwidth. The second new feature is the use of a hybrid circuit for providing a 90° phase shifting function necessary for circular polarization to obtain satellite compatibility. A third exception is the use of frequency selective antenna elements. The elements are made to operate at two different frequencies due to the addition of a resonant circuit. The resonant circuit is uniquely configured so that the antenna system is easily deployable.

BRIEF DESCRIPTION OF THE DRAWINGS

For a more complete understanding of the present invention and the advantages thereof, reference is now made to the following description of the preferred embodiment taken in conjunction with the accompanying drawings in which.

DESCRIPTION OF THE PREFERRED EMBODIMENT

Figure 1:
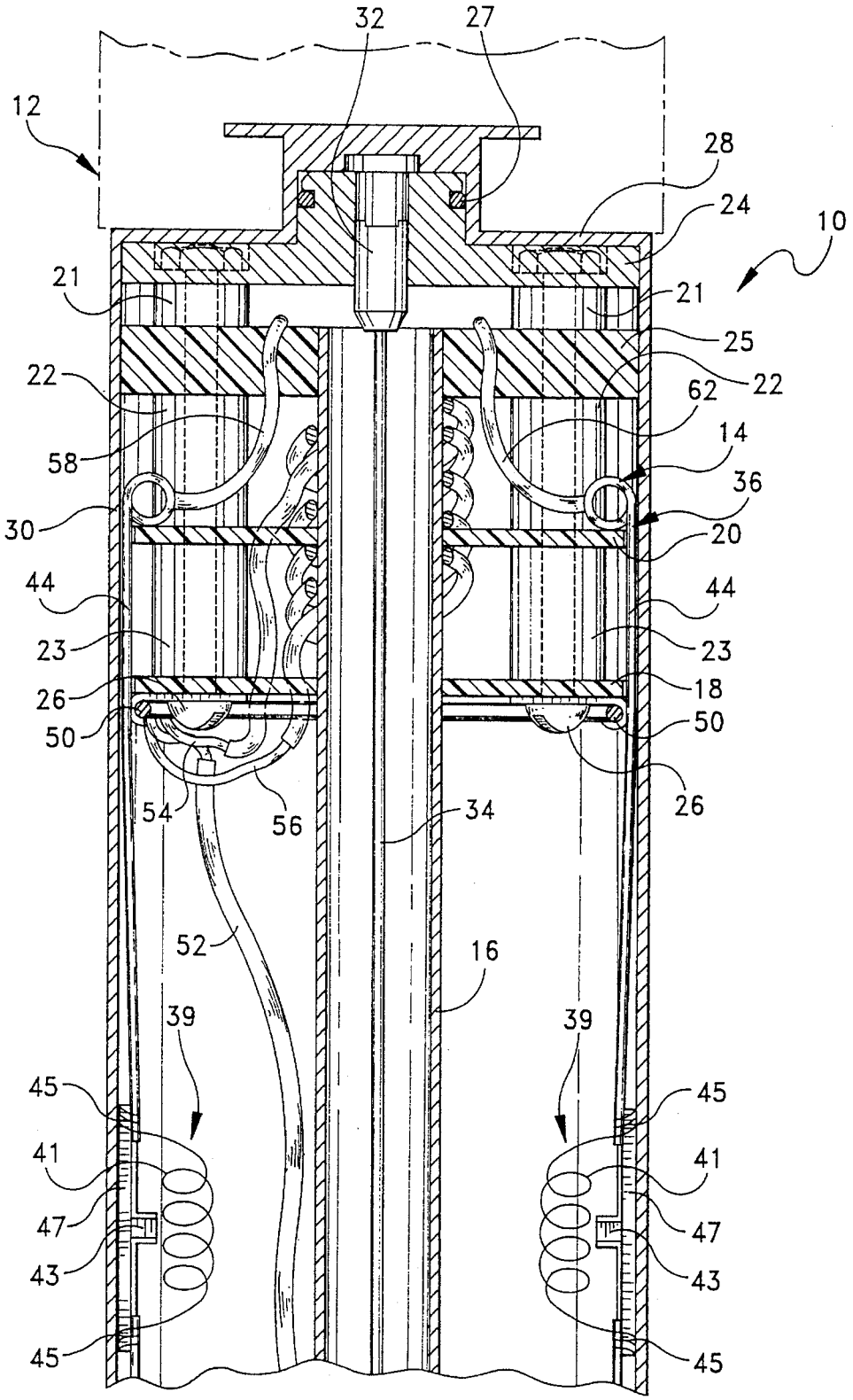
FIG. 1 is a fragmentary sectional view of the portion of a deployable antenna assembly in accordance with the present invention containing the bulk of the operating components.

Refer now to the drawing of FIG. 1 where there is fragmentarily illustrated a deployable antenna assembly for marine applications. A tubular canister 10 having a closed top end wall or end cap 28 has disposed above it a penetrator 12 illustrated in a phantom line. An antenna system 14 is disposed within the canister 10. There is also shown an elongated cylindrical mast 16 extending axially through circular shaped mounting members 18 and 20, and a member 25 in the shape of a Greek Cross having a center aperture of sufficient size to pass the cylindrical mast 16 through.

A cap 24, having an O-ring seal 27, bears against end cap 28. A plurality of spacers 21, 22, and 23 are placed respectively between cap 24 and member 25, members 25 and 20, and members 20 and 18, respectively. Fasteners 26 maintain the elements in assembly. As seen in FIG. 1 the canister 10 is comprised of the cap 24 and end cap 28 with its extension of a cylindrical body 30.

Seated in a coaxial cavity in the cap 24 is a discharge element 32 which is actuable by a signal transmitted thereto through the conductor 34.

Figure 2:
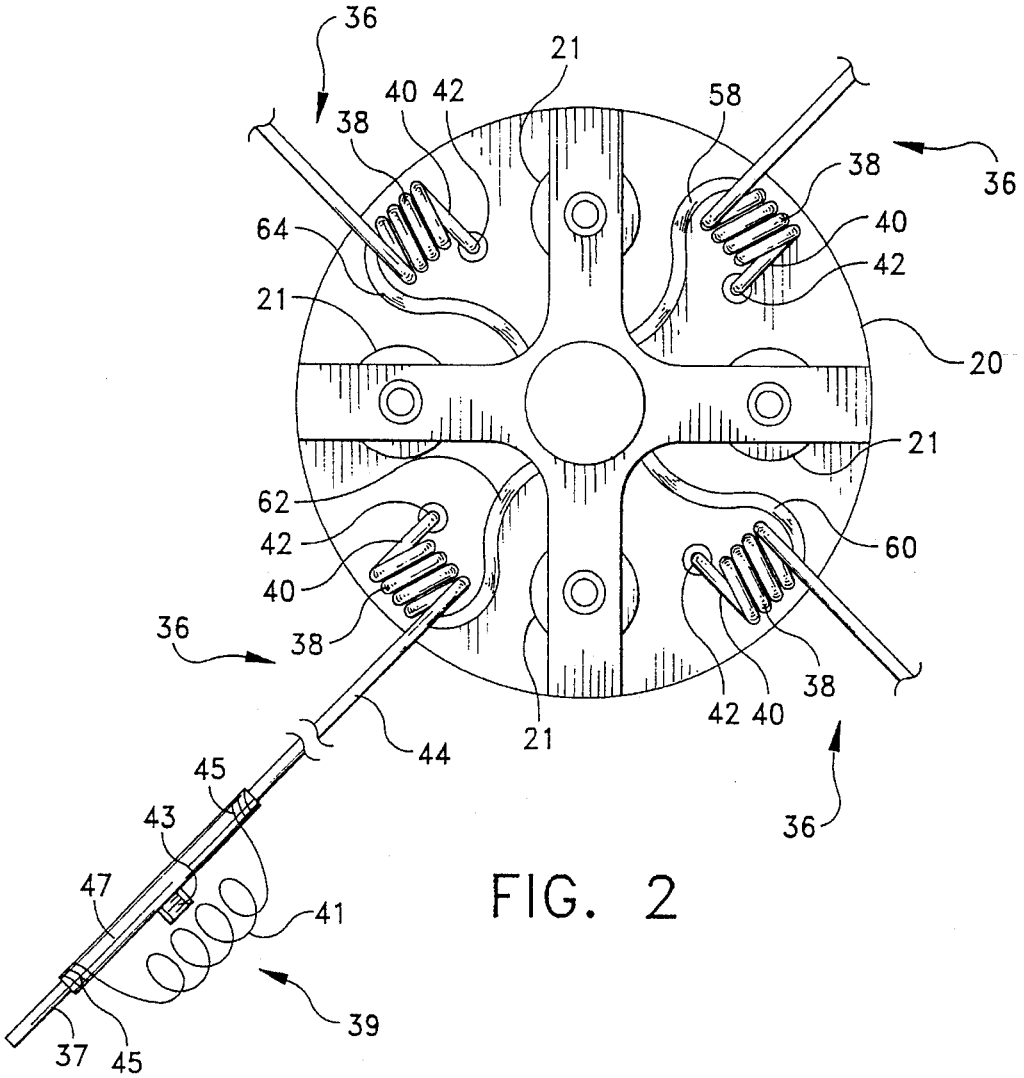
FIG. 2 is a plan view of the antenna assembly of FIG. 1 following deployment.

As shown in FIGS. 1 and 2, four identical antenna elements generally designated by the numeral 36 are spaced about the periphery of the mounting member 20 at 90° intervals, and each comprising a length of resiliently deflectable wire formed into a helical coil 38 with a tail 40 extending from one end thereof which is affixed to the mounting member 20 by fasteners or bonding as indicated by the numeral 42. Extending from the opposite end of the coil 38 is an elongated arm 44. Second antenna arms 37 are attached to respective arms 44 by means of a resonant circuit 39 at a point substantially 6.5 inches along the arm 44. This resonant circuit of an inductor 41 and a capacitor 43, as shown in FIGS. 1 and 2, electrically decouples the last 2.75 inches of antenna element depicted as 37 at 350 MHz, by means of an open circuit, thereby allowing the element 44 to be an efficient radiator at this frequency. The circuit is effectively a short circuit at 250 MHz which allows the entire length including both elements 37 and 44 to radiate.

When the antenna elements 36 are unrestrained they will extend in a horizontal plane as indicated in FIG. 2. Opposing pairs of antenna elements 36 form dipoles.

Affixed to both antenna arms 37 and 44 by means of a cord 45 is a smooth insulated material 47 such as plastic that protects inductor 41 and capacitor 43 from cylindrical body 30 prior to and during deployment of the antenna element 36. The material 47 is positioned to abut the inside of cylindrical body 30 prior to deployment. This provides for safe storage prior to deployment and smooth operation upon deployment.

Figure 3:
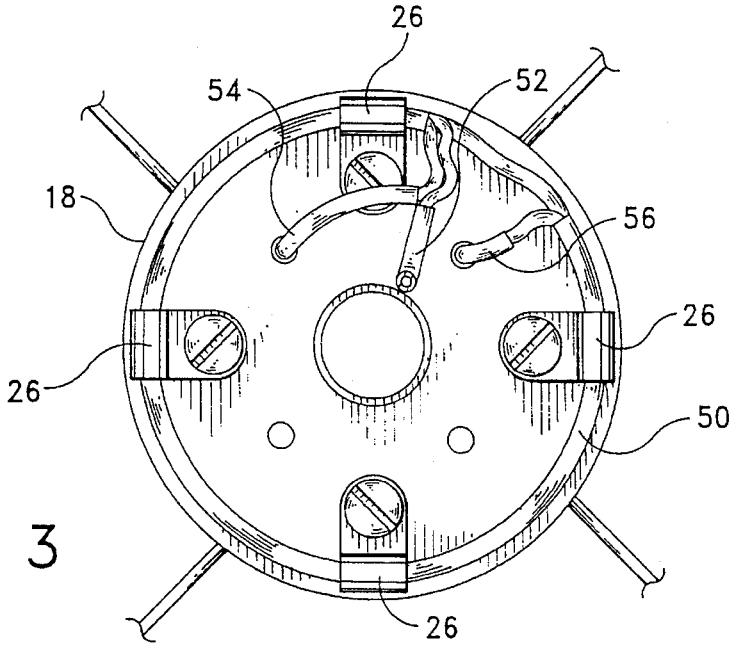
FIG. 3 is a bottom view showing the hybrid coupling phase shifter.

Refer now to FIGS. 1 and 3 wherein there is shown a hybrid coupling phase shifter 50 for providing the 90° phase shifting function necessary for circular polarization. This off-the shelf phase shifter 50 has a frequency range of 200–400 MHz. The fasteners 26 secure the phase shifter 50 to the mounting member 18 on its underneath side. A coaxial cable 52 has an inner wire containing an RF input signal connected to phase shifter 50. The phase shifter 50 in turn connects to both coaxial cables 54 and 56 so that a 90° phase shift exists between cables 54 and 56. Coaxial cables 54 and 56 pass through separate apertures in mounting member 18.

Figure 4:
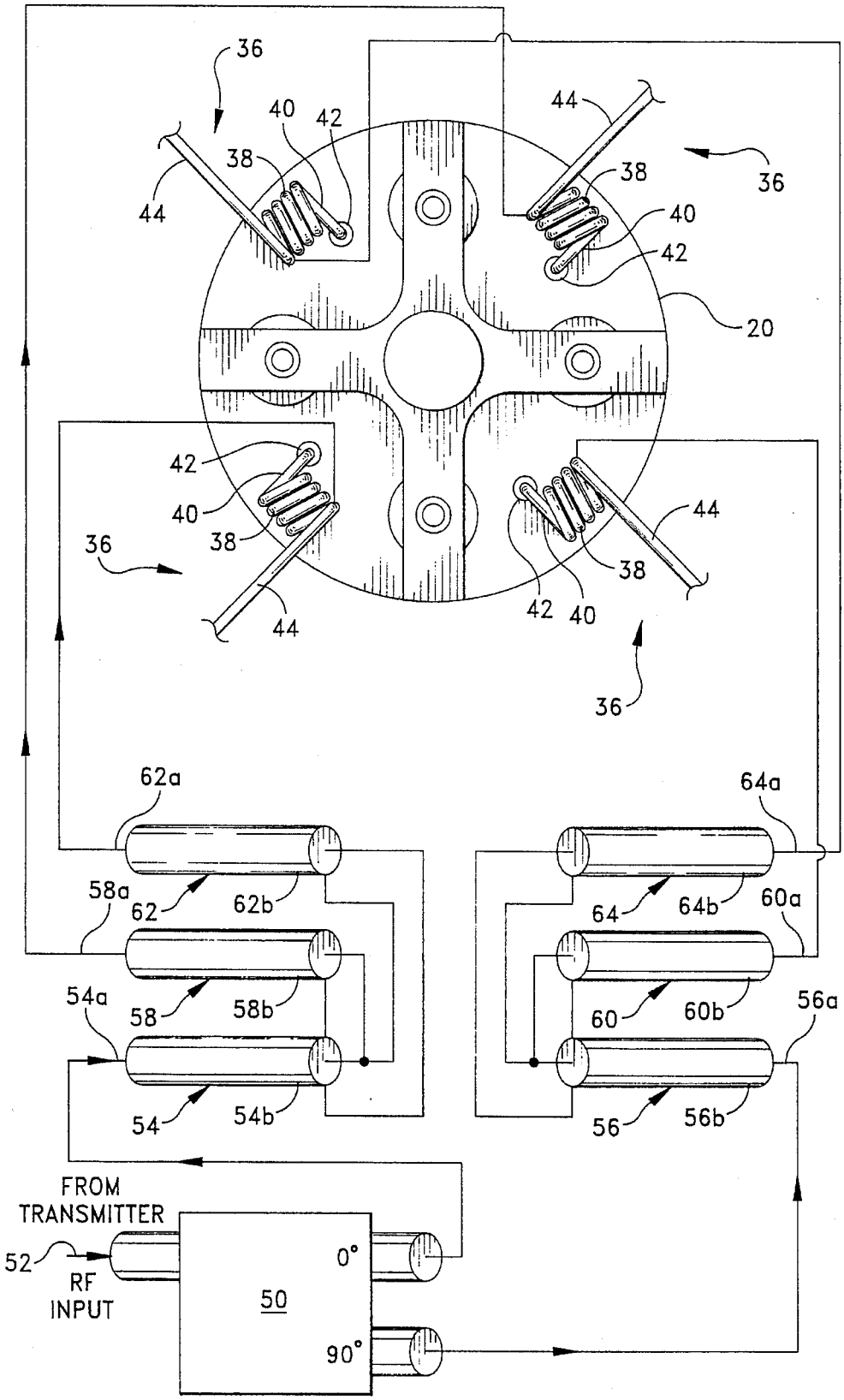
FIG. 4 shows the interconnections of hybrid coupling phase shifter, coaxial cables, and antenna elements.

Refer now to FIG. 4 wherein there is shown a diagram of the hybrid phase shifter 50 and the assemblage of coaxial cables forming baluns and their connection to the four antennas 36. Cables 54, 58, and 62 form one balun and cables 56, 60, and 64 form another balun. Coaxial cables 54 and 56 each receive an RF input signal 90° out of phase with each other from coaxial cable 52 through hybrid circuit 90° phase shifter 50 to center conductors 54*a* and 56*a*, respectively. The center conductor 54*a* of coaxial cable 54 is connected to the center conductor 58*a* of coaxial cable 58 and to the shield 62*b* of coaxial cable 62. The shield 54*b* of coaxial cable 54 is connected to the shield 58*b* of coaxial cable 58 and to the center conductor 62*a* of coaxial cable 62.

Similarly, the center conductor 56*a* of coaxial cable 56 is connected to the center conductor 60*a* of coaxial cable 60 and to the shield 64*b* of coaxial cable 64. The shield 56*b* of coaxial cable 56 is connected to the shield 60*b* of coaxial cable 60 and to the center conductor 64*a* of coaxial cable 64.

The wire 62*a* is connected to one of the antenna elements 36. The wire 58*a* is connected to the antenna element 36 that is spaced 180° from the antenna element 36 connected to wire 62*a*.

Similarly, the wire 64*a* is connected to another antenna element 36. The wire 60*a* is connected to the remaining antenna element 36 that is spaced 180° from the antenna element 36 connected to wire 64*a*.

When in use, the antenna assembly is directed to the water surface from an underwater vehicle or facility. The penetrator 12 shown in FIG. 1 effects a penetration through a surface ice, after which the discharge element 32 is actuated to propel from the antenna assembly the penetrator 12 and the canister 10. This frees the antenna arms 44, 37, for deployment. A buoy (not shown) maintains the antenna mast in an elevated position relative to the environment so that the antenna elements 36 are spaced above the water or surrounding ice pack. All components subject to short circuiting, by the environment including the water, are potted with an insulating material. For clarity sake, this is not shown in the drawings. The relatively compact profile of the antenna assembly provides reasonable stability, even in wind speeds of 70 miles per hour.

Thus it can be seen that the antenna assembly of the present invention is one which is readily deployable from its storage conditions to its operative position. The components are relatively simple and economical to fabricate and the components, when assembled, are relatively protected from the hostile marine environment to enable use for a reasonable working period without loss in efficiency.

It will be understood that various changes in the details, materials, steps and arrangement of parts, which have been herein described and illustrated in order to explain the nature of the invention, may be made by those skilled in the art within the principle and scope of the invention as expressed in the appended claims.

What is claimed is:

1. A circularly polarized dual frequency lightweight deployable antenna system comprising:

a canister having an elongated chamber;

an elongated hollow mast extending within said chamber and having its upper end spaced below the upper end of said canister;

a first, second, and third mounting members spaced from each other along a common axis with said first mounting member on the upper end of said mast and said third mounting member below said first and second mounting members on said mast;

four antenna members of resiliently deflectable wire spaced at 90 degree intervals about the periphery of said second mounting member, and each comprising a generally helical coil mounted on said second mounting member and elongate arms extending downwardly along the periphery of said second and third mounting members and along the inner walls of said canister, opposed pairs of said antenna members comprising dipoles, each of elongate arms comprising a pair of resiliently deflectable wires separated by a resonant circuit that provides a short circuit at a first predetermined frequency and an open circuit at a second predetermined frequency, an electrically insulated material connected to each of said elongated arms and separating each of said resonant circuits from said inner walls of said canister;

first and second baluns with each balun connected to opposite antenna members and each of said baluns comprises first, second, and third lengths of coaxial cables, and said first length of coaxial cable having its center conductor at one end connected to receive a signal from one output of a hybrid circuit, said first length of coaxial cable at its other end having its center conductor connected to the center conductor of one end of said second length of coaxial cable and to the shield of one end of said third length of coaxial cable, said first length of coaxial cable at said other end having its shield connected to the shield of said one end of said second length of coaxial cable and to the center conductor of said one end of said third length of coaxial cable, said second and third coaxial cables at their other ends having their center conductors connected respectively to a pair of said antenna members that are spaced 180 degrees from each other;

said hybrid circuit providing a 90 degree phase shifting function for circular polarization having an input for receiving radio signals and a pair of outputs providing electrical spacing of 90 degrees, said pair of outputs connected to respective members of said first and second baluns; and said coils of said antenna members being flexed when said arms are in the downwardly extending position within said canister, said canister being slidable relative to said mast and antenna members for freeing said arms therefrom for extension into a horizontal position.

2. A circularly polarized dual frequency lightweight deployable antenna system according to claim 1 wherein said deployable antenna system includes canister removal means for projecting said canister upwardly to release said arms for movement into the horizontal position.

3. A circularly polarized dual frequency lightweight deployable antenna system according to claim 2 wherein said canister removal means comprises a discharge element within said canister actuable upon receipt of a signal, and a signal conductor connected thereto.

4. A circularly polarized dual frequency lightweight deployable antenna system according to claim 3 wherein said hybrid circuit being connected to said third mounting member.

5. A circularly polarized dual frequency lightweight deployable antenna system according to claim 3 wherein each of said resonant circuits comprises an inductive coil and a capacitor connected in parallel with each other.

* * * * *